United States Patent [19]

Kamiya et al.

[11] 4,432,894

[45] Feb. 21, 1984

[54] PROCESS FOR TREATMENT OF DETERGENT-CONTAINING RADIOACTIVE LIQUID WASTES

[75] Inventors: Kunio Kamiya, Hitachi; Kenji Motojima, Mito; Kiyomi Funabashi, Katsuta; Koichi Chino; Susumu Horiuchi, both of Hitachi, all of Japan

[73] Assignee: Hitachi, Ltd., Tokyo, Japan

[21] Appl. No.: 249,012

[22] Filed: Mar. 30, 1981

[30] Foreign Application Priority Data

Apr. 4, 1980 [JP] Japan ..... 55-44930

[51] Int. Cl.[3] ..... G21F 9/08; G21F 9/12

[52] U.S. Cl. ..... 252/632; 210/662; 210/739; 210/751; 252/628; 252/631

[58] Field of Search ..... 210/662, 682, 691, 694, 210/748, 751, 770, 771, 901, 909, 910, 911, 739; 252/628, 631, 632, 635

[56] References Cited

U.S. PATENT DOCUMENTS

| | | | |
|---|---|---|---|
| 3,196,106 | 7/1965 | Haden et al. | 252/628 |
| 3,243,380 | 3/1966 | Conn | 252/631 |
| 3,896,045 | 7/1975 | Peeters et al. | 252/631 |
| 4,033,868 | 7/1977 | Meichsner et al. | 252/632 |
| 4,203,863 | 5/1980 | Knotik et al. | 252/632 |

FOREIGN PATENT DOCUMENTS

| | | | |
|---|---|---|---|
| 51-124800 | 10/1976 | Japan . | |
| 52-76600 | 6/1977 | Japan | 210/751 |
| 54-101100 | 8/1979 | Japan . | |

*Primary Examiner*—Ivars C. Cintins

*Attorney, Agent, or Firm*—Mary Louise Beall

[57] ABSTRACT

A detergent-containing radioactive liquid waste originating from atomic power plants is concentrated to have about 10 wt. % detergent concentration, then dried in a thin film evaporator, and converted into powder. Powdered activated carbon is added to the radioactive waste in advance to prevent the liquid waste from foaming in the evaporator by the action of surface active agents contained in the detergent. The activated carbon is added in accordance with the COD concentration of the radioactive liquid waste to be treated, and usually at a concentration 2–4 times as large as the COD concentration of the liquid waste to be treated. A powdery product having a moisture content of not more than 15 wt. % is obtained from the evaporator, and pelletized and then packed into drums to be stored for a predetermined period.

18 Claims, 4 Drawing Figures

PROCESS FOR TREATMENT OF DETERGENT-CONTAINING RADIOACTIVE LIQUID WASTES

This invention relates to a process for the treatment of radioactive liquid wastes containing detergents, and particularly of laundry drainage containing detergents used for cleaning contaminated working clothes.

At atomic power stations, etc. the radioactive laundry drainage containing detergents resulting from washing of contaminated working clothes usually amounts to several thousand cubic meters a year. These radioactive liquid wastes contain surface active agents such as sodium dodecylbenzenesulphonate and alkylphenol polyoxyethylene ether, which are ingredients of detergents. In general, radioactive liquid wastes are subjected to a final treatment after concentration to about 1/500 their original volume by evaporation or reverse osmosis. It is well-known, however, that radioactive liquid waste containing a surface active agent, if concentrated in its original condition, generates foams to prevent its concentration. Addition to the liquid waste of anti-foams such as powdered activated carbon (see Japanese Laid-open Patent Application No. 124,800/1976) and used ion exchange resin (see Japanese Laid-open Patent Application No. 101,100/1979), which adsorb the surface active agent, have hitherto been proposed as a means to prevent the foaming.

On the other hand, some of the present inventors recently developed a process of converting the radioactive liquid waste which has been concentrated and made smaller in volume into powder by the use of a thin film evaporator and thereafter pelletizing the powdered waste for the convenience of storing it.

The thin film evaporator is an apparatus having wiping blades within; the radioactive liquid waste is brought into contact with the heated inner wall of the apparatus in the form of a thin film, part of the waste is evaporated while it goes down along the wall and the remains are recovered in the form of powder.

The following defects have been found for the first time as a result of the studies made by the present inventors.

The process has a defect that the radioactive liquid waste fed to and concentrated in the evaporator tends to adhere to the blades, the recovered powdery material shows a high moisture content and at times the waste comes out of the apparatus without having been converted to powder, as was discovered later by the inventors.

We then experimented on the effect of various kinds of adsorbent, which were added in accordance with the concentration of the detergent in the waste to counteract the surface active agent contained in the detergent, upon the powder-forming capacity of said evaporator, and found that although the capacity was clearly improved by the addition of adsorbent, the amount of the recovered powdery material was increased embarrassingly. This is a very serious problem, for in the treatment of radioative liquid waste it is most highly desirable to minimize the volume of the finished product in powder or pellet form.

The object of the present invention is to produce a powdery material of low moisture content out of radioactive liquid waste containing detergents by adding a minimum of adsorbent to the waste.

The invention is characterized in that an adsorbent is added in a quantity which corresponds to the chemical oxygen demand (COD) concentration of the waste when radioactive liquid waste containing detergents is to be converted to powder. It is based on our discovery that the COD concentration of the waste is the good measure of the total amount of the substances which hinder powder formation and are therefore to be removed by adsorbents. In other words, it has been found that not only detergents or surface active agents but also various auxiliaries included in the detergents for the purposes of pH adjustment and uniform distribution of surface active agent and impurities in the waste due to stains, etc. on clothing affect powder formation adversely. Accordingly, an optimum amount for additives can never be attained by merely determining the concentration or quantity of detergents or surface active agents in the waste and then estimating, on the basis thereof, the amount of adsorbents to be added for the purpose of restraining the foaming due to the presence of surface active agents, and consequently the additive amount is found to have been either so small as to increase the moisture content of the resultant powder or so large as to increase the amount thereof embarrassingly.

On the other hand, the necessary and sufficient amount of adsorbents to be added for which the presence of auxiliaries, stains, etc. has been taken into account can be estimated on the basis of COD concentration of the waste, for the COD concentration sensitively corresponds to the types of surface active agents and auxiliaries, degree of deterioration of said agents due to stains, etc. on clothing, and other factors.

Examples of suitable adsorbents are powdered active carbon, molecular sieve, silica gel, alumina, and other powdered adsorbents having a large surface area. The impurities in the radioactive waste are adsorbed by addition of a necessary quantity of the adsorbent. More particularly, the surface active agents that cause foaming are adsorbed all but entirely and the foaming ceases to occur in the course of powder formation, and consequently the moisture content of the resultant powder decreases remarkably.

The invention is also characterized in that the radioactive waste converted to powder by the above process is further pelletized. The powder to be pelletized contains the adsorbent incorporated in powder form, the adsorbent particles having adsorbed a moderate amount of moisture coming from the waste on their porous surfaces. These porous surfaces help combine all the powder particles into tight pellets. For this reason the resultant pellets exhibit a breaking strength about 1.5 to 2 times as high as that of pellets containing no adsorbent. The pellets should be made as strong as possible lest they should cause breakage and scatter radioactive substances during their transportation. It is therefore an advantage of the present invention that the resultant pellets exhibit a higher breaking strength as well as a lower moisture content.

It is a third characteristic of the invention that a thin film evaporator provided with wiping blades is employed for the formation of powder. Abrasion of the wiping blades poses a serious problem for the thin film evaporator, for the blades tend to come in contact with the inner wall of the evaporator during their rotation at high speed.

In the present invention the powdered adsorbent added to the liquid waste serves as a buffer between the inner wall and the wiping blades to retard the rate of abrasion of the blades remarkably.

It is a fourth characteristic of the invention that the liquid waste of a fixed COD concentration can be used for powder formation by adjusting the concentration of the radioactive waste to be converted to powder instead of varying the amount of the adsorbent to be added according to the COD concentration of the radioactive waste. In the invention the amount of adsorbent to be added is unchanged, since the COD concentration is fixed beforehand.

The other characteristics of the invention will be described in detail below in connection with the accompanying drawings.

DETAILED DESCRIPTION OF THE INVENTION

The present invention is characterized by mixing an adsorbent with a radioactive liquid waste containing a surface active agent and thereafter subjecting the waste to concentration and drying.

A satisfactory powdery product having a low moisture content is obtained by mixing powdery or particulate activated carbon with a detergent-containing radioactive liquid waste and then subjecting the mixture to the action of a thin film evaporator; it has been experimentally confirmed that properties, and particularly the moisture content of the product depend on the mixing ratio of activated carbon to the chemical oxygen demand (COD) of the radioactive waste. The present invention is based on such finding.

The experimental results are given below.

Activated carbon is mixed with a radioactive waste of 10 wt. % detergent concentration, and then the mixture is fed to a thin film evaporator, 2 $m^2$ in heating surface area at a flow rate of 160 kg/hr to be evaporated and dried at 170° C.

Figure 1:
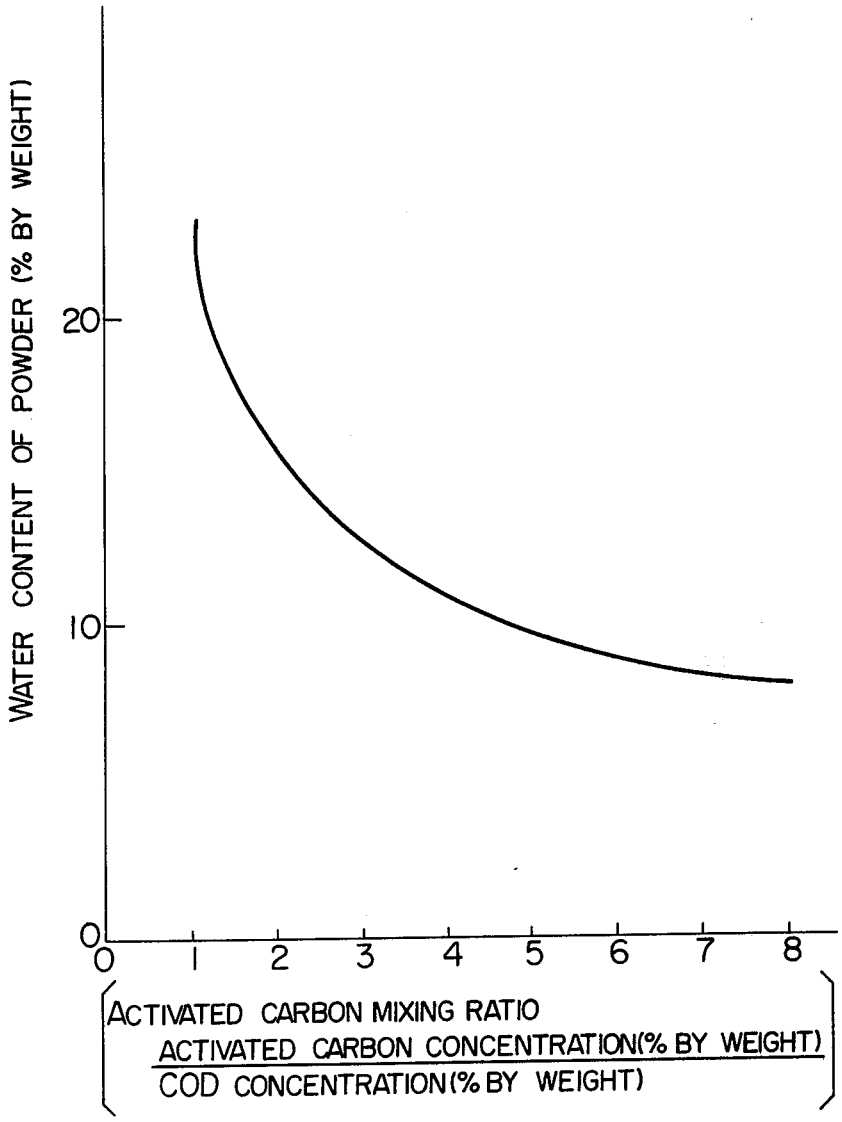
FIG. 1 is a characteristic diagram showing the relation between the activated carbon mixing ratio and the moisture content of the resultant powder.

FIG. 1 shows the moisture content of the powder obtained by the above treatment varied with the activated carbon mixing ratio. The latter means [concentration (wt. %) of activated carbon in the waste]/[COD concentration (wt. %) of the waste]. It is easily seen that the moisture content of the resulting powder lowers with increasing activated carbon mixing ratio, and this result attests to the effectiveness of activated carbon incorporation, because the surface active agent and other ingredients of the detergent contained are adsorbed by the activated carbon having a large surface area, and their undesirable effect are removed.

A similar effect was obtained by the use of other adsorbents having large surface area, such as molecular sieve, silica gel and alumina.

FIG. 1 indicates that the mixing ratio is preferably not less than 1 because the moisture content of the resulting powder increases rapidly when the mixing ratio is less than 1. It is more preferable that the mixing ratio is 2–4, as a range for a remarkable decrease in the moisture content below 15 wt. % by addition of activated carbon.

Furthermore it has been found that the volume of the resultant powder or pellets can be made as small as possible at the mixing ratio of about 3. It has been experimentally confirmed that the powdery product resulting at the mixing ratio can easily be pelletized into pellets of high strength suitable enough for handling and storing. According to the experiments, pellets shaped without the activated carbon addition have a breaking strength of about 60 kg/piece, whereas pellets with the activated carbon at the mixing ratio of 3 have an improved strength of about 100 kg/piece.

Figure 2:
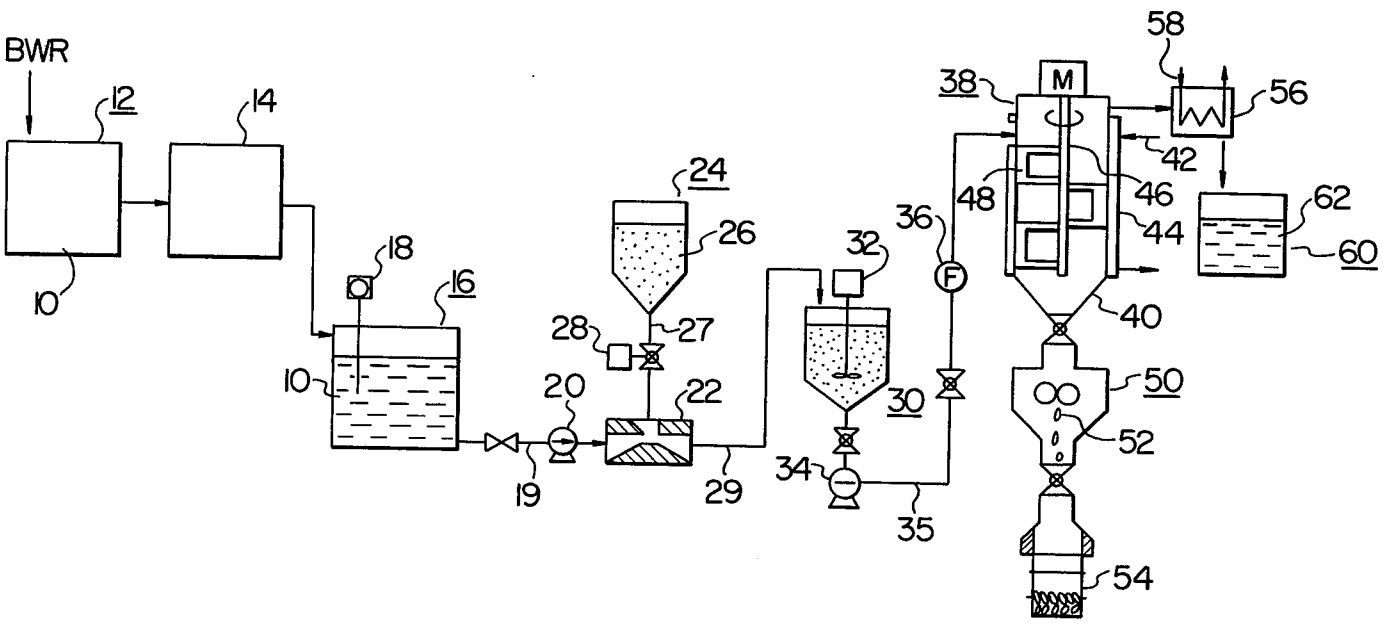
FIG. 2 is a flow diagram for an example of the invention.

FIG. 2 shows a flow diagram of an apparatus for the treatment of radioactive liquid waste suitable for carrying out the present invention.

Waste tank 16 containing radioactive liquid waste 10 with a surface active agent connected to an ejector 22 through piping 19 provided with a pump 20. Tank 24 containing powdery or granular activated carbon 26 is connected to the ejector 22 through a piping 27 provided with a device 28 for adjusting the amount of the activated carbon. Pipe 29 connects the ejector 22 to a mixing tank 30 provided with a stirrer 32. Pipe 35 provided with a feed pump 34 and a flow meter 36 connects the mixing tank 30 to a thin film evaporator 38.

Rotary shaft 46 is provided inside vessel 40 of the thin film evaporator 38, and wiping blades 48 are rotatably provided at the rotary shaft 46. A jacket 44 is provided at the outside of vessel 40. Steam feed pipe 42 is connected to the jacket 44. Numeral 50 is a pelletizer and 54 is a drum.

Surface active agent-containing radioactive liquid waste 10 (e.g., laundry drainage) generated in a boiling water-type atomic power plant is concentrated in a reverse osmosis apparatus 12, and then further concentrated in a concentrator 14 to a predetermined concentration, e.g., 10 wt. %, and then fed to the waste tank 16. The COD concentration of the waste 10 is measured by a COD meter 18 provided inside the waste tank 16. A commercially available automatic COD measuring device can be used as the COD meter.

Then, the waste 10 is fed to the ejector 22 by driving a transfer pump 20. By the action of ejector 22 granular activated carbon 26, about 250 microns in particle size and 800 $m^2$/gr in specific surface area, added to the waste 10 from the tank 24. The device 28 for adjusting the amount of activated carbon is adjusted so that the amount of activated carbon 26 corresponding to the measured COD concentration can be fed to the ejector 22. The waste 10 containing activated carbon 26 is transferred to the mixing tank 30 and mixed further by the action of the stirrer 32. Thereafter, by driving the feed pump 34, the waste is fed into the vessel 40 of the thin film evaporator 38 through the flow meter 36. The surface of the container wall is heated by the steam fed into the jacket 44 through the steam feed pipe 42. As the rotary shaft rotates, wiping blades 48 travel in the circumferential direction of the vessel 40 along the inner wall; whereas the waste 10 is pressed against the inner wall to form a thin film thereon by the centrifugal force of the blades 48 and then flows down along the inner wall while heated. The waste 10 is concentrated, dried and converted to powder by the action of the blades 40. It can easily be pulverized because the surface active agent contained in the waste is adsorbed on activated carbon 26. The activated carbon 26 is also powdered by the wiping blades 48. The resulting powdery product is taken out of the vessel 40 at its bottom.

This product containing activated carbon is shaped into pellets 52 by a pelletizer 50 and then packed in drums 54. Then, asphalt or a plastic is poured into each drum 54 to solidify the powder. Steam from the evaporator 38 is led to a condenser 56, cooled by cooling water 58, and recovered in a condensate water tank 60 as condensate 62. Because of the porosity of the activated carbon, the powder prepared from the waste 10 enters the pores when pelletized to form pellets of high strength.

Description will be made below of a case where one cubic meter of the radioactive waste containing about 10 wt. % of a detergent and a COD concentration of 0.7 wt. % is treated in the apparatus of FIG. 2.

If the activated carbon mixing ratio of 3 is selected for safety on the basis of the experimental results shown in FIG. 1, the concentration of the activated carbon 26 to be added will be 2.1 wt. %, i.e. three times the COD concentration of the radioactive waste (0.7 wt. %). 21 kg of granular activated carbon 26 is added to the waste 10 from the tank 24 and fully mixed in the mixing tank 30. Then, the mixture is introduced into the evaporator 38 at a rate of 200 kg/hr. A powdery product is obtained at a rate of about 20 kg/hr from the evaporator 38 at 170° C., and the waste 10 is converted to powder. The moisture content of the powdery product was about 10 wt. %.

The COD concentration includes such factors as type of surface active agent and the degree of deterioration thereof. A proper amount of activated carbon can be added because the amount of granular activated carbon to be added to the radioactive waste is adjusted on the basis of the COD concentration of the waste containing surface active agent. The amount of activated carbon to be added varies with the type of surface active agent and the degree of deterioration thereof. Accordingly, if the amount of activated carbon is selected solely on the basis of the concentration of detergent or surface active agent, too a small or too a large amount is inevitably added and the proper amount cannot be added. Too much activated carbon increases the amount of the resultant radioactive waste, whereas in the present invention the amount of activated carbon added is so small that the increase in an amount of the resultant waste is very small. By converting the radioactive liquid waste containing the surface active agent to the form of powder its volume can be decreased remarkably. Besides, the resulting powder has a low moisture content and can easily be pelletized, so its volume can be made even smaller.

The foregoing example of the invention is directed to the treatment of radioactive liquid waste containing detergents alone. However, in the boiling water-type atomic power plants are generated not only the detergent-containing radioactive waste but also slurry-type radioactive waste containing used powdery ion exchange resin, sodium sulphate-containing radioactive waste resulting from regeneration of used ion exchange resin, etc.

Thus, the present invention is applicable to (1) a mixture of radioactive liquid waste containing surface active agents and radioactive liquid waste containing sodium sulphate and (2) the mixture of (1) mixed further with slurry-type radioactive waste containing used powdery ion exchange resin.

Activated carbon is added to the mixture (1) or (2) and then the resulting mixture is converted into powder in the thin film evaporator of FIG. 2. Then, the moisture content of the powder is measured. The results are shown in the following Table. The concentration of surface active agents in the detergent is 14 wt. % in each case.

TABLE

| Exp. No. | Percentage of ingredients in the waste (wt. %) Detergent | $Na_2SO_4$ | Powdery ion exchange resin | Moisture content of resultant powder (wt. %) |
|---|---|---|---|---|
| 1 | 10 | 90 | 0 | 7.4 |
| 2 | 25 | 75 | 0 | 11.0 |
| 3 | 50 | 50 | 0 | 12.7 |
| 4 | 75 | 25 | 0 | 13.5 |
| 5 | 100 | 0 | 0 | 14.0 |
| 6 | 34 | 33 | 33 | 3.5 |
| 7 | 66 | 17 | 17 | 5.2 |
| 8 | 80 | 10 | 10 | 7.4 |
| 9 | 90 | 5 | 5 | 10.0 |

It is seen from the Table that all the powder produced by treating radioactive liquid wastes of varied compositions have moisture contents of not more than 14 wt. %, and that by the addition of activated carbon the mixed waste can be converted into powder easily with satisfactory result.

It must be because part of the surface active agents which are main ingredient of the detergent, that is, ionic surface active agents, are retained on the surface of the powdered ion exchange resin owing to ion exchange, etc. that the resulting powder has a lower moisture content when the mixed waste to be treated contains a powdery ion exchange resin.

Figure 4:
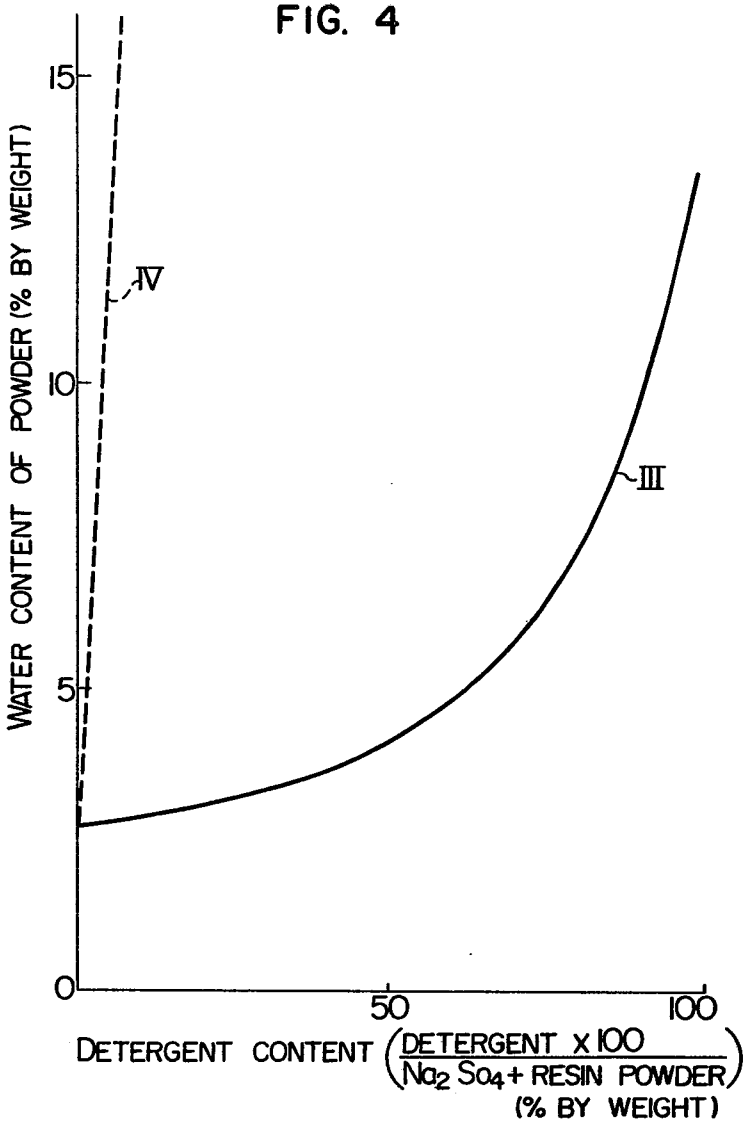
FIGS. 3 and 4 are characteristic diagrams showing the relation between the detergent content of the waste and the moisture content of the resultant powder.
Figure 3:
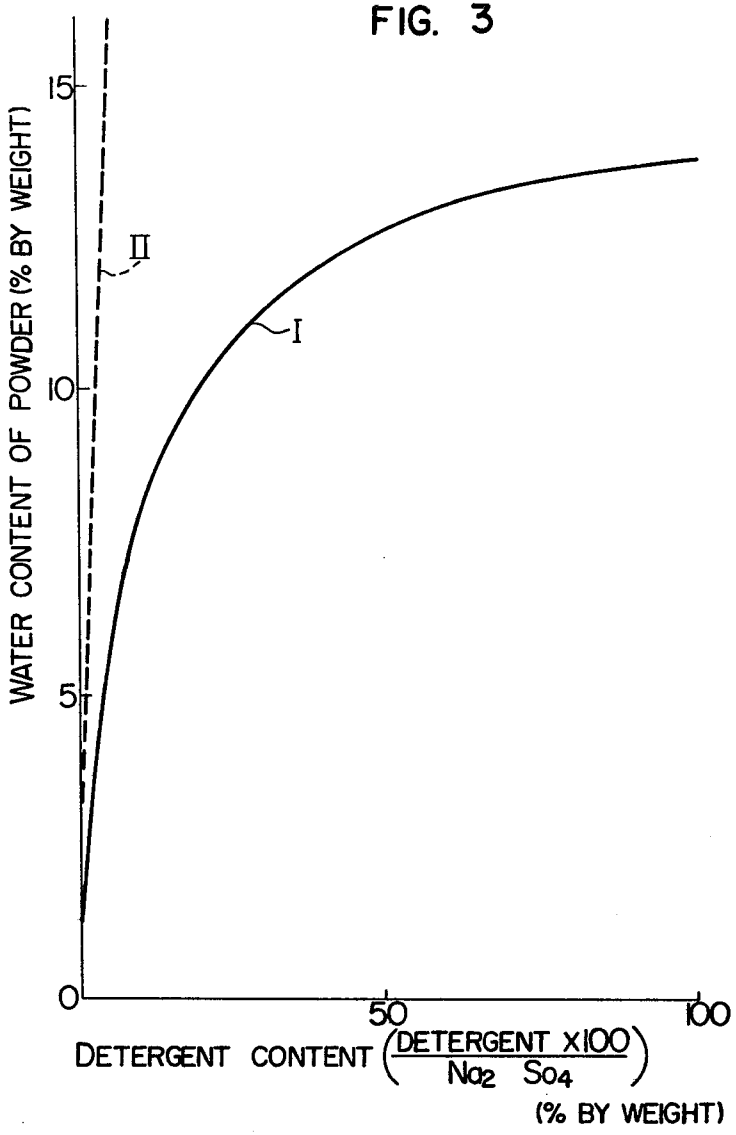

FIG. 3 shows comparison of the case where activated carbon is added to the mixed waste (1) with the case where no activated carbon is added to the same waste in respect to the moisture content of the powder produced; and FIG. 4 shows comparison of the case where activated carbon is added to the mixed waste (2) with the case where no activated carbon is added to the same waste in respect to the moisture content.

In FIGS. 3 and 4, curves I and III are characteristic curves obtained when activated carbon is added according to the present invention; whereas curves II and IV are characteristic curves of the prior art in which no activated carbon is added. In the prior art cases, as shown by curves II and IV, the mixed waste can be converted into powder when its detergent content is low because the detergent ingredients are, to some extent, retained by sodium sulphate and the powdery ion exchange resin; but in case the detergent content exceeds 5 wt. %, the moisture content of the product obtainable by the treatment of the mixed waste increases so rapidly, and the powder formation cannot be attained. On the other hand, in the present invention, a satisfactory powdery product not exceeding 14 wt. % in moisture content can be obtained in every case, inclusive of the case where the radioactive waste to be treated contains a detergent alone. If the moisture content of the resulting powder exceeds 15 wt. %, the amount of moisture on the surface of powder particles increases so as to make pelletizing difficult.

According to the present invention, detergent-containing radioactive liquid wastes of various compositions generated in atomic power plants, etc. can easily be converted into powder, and the resulting powder has a low moisture content and is therefore suitable for pelletizing, and thus the amount of radioactive waste to be stored can be minimized. Activated carbon serves as a buffer between the wall surface and the wiping blades and lessens abrasion of the blades of the thin film evaporator. Other adsorbents as described above have also an effect of lessening the abrasion. As described before, molecular sieve, silica gel, alumina, etc. may be used in place of activated carbon and it is desirable that it should have a large surface area. If the surface area is small, the amount thereof to be added will increase.

The addition of the adsorbent is made in accordance with the COD concentration of the radioactive waste in the foregoing examples, but by fixing the maximum content (or maximum COD concentration) of the detergent contained therein to a predetermined value, a necessary amount of adsorbent can be added on the basis of the fixed content or concentration. In the latter case, operation can be made very simple but there appears such a disadvantage that the amount of adsorbent to be added will increase.

A thin film evaporator is used as the apparatus for evaporation and drying in the foregoing embodiments, but the invention can be effectively carried out by pulverization by other means for concentration and drying, such as fluidized-bed concentration and drying. The resulting particle size and other properties inevitably vary with the drying system as used.

It will be needless to say that the present invention is generally applicable to liquid wastes of chemical plants, though the waste to be treated has been limited to radioactive waste originating from atomic power plants in the foregoing embodiments.

In a word, radioactive liquid wastes containing surface active agent can be converted into powder of low moisture content, resulting in remarkable decrease in its volume according to the present invention.

What is claimed is:

1. A process for the treatment of detergent-containing radioactive liquid waste, said waste comprising sodium sulfate and powdery ion exchange resin, said process comprising:

(a) measuring a chemical oxygen demand concentration of a radioactive liquid waste, (b) adding an adsorbent to the waste in accordance with the measured concentration, and (c) concentrating and drying the waste by heating, thereby converting the waste into powder.

2. A process according to claim 1, wherein the powder contains 15 wt. % moisture or less and which further comprises a step of shaping the powder into pellets.

3. A process according to claim 1 or 2, wherein the adsorbent added to the waste is at a concentration not lower than the measured concentration of the waste.

4. A process according to claim 3, wherein the adsorbent added to the waste is at a concentration 2 to 4 times as high as the measured concentration of the waste.

5. A process according to claim 4, wherein powder of at least one member of substance selected from the group consisting of activated carbon, silica gel, molecular sieve and alumina is used as said adsorbent.

6. The process according to claim 4, wherein the adsorbent added to the waste is at a concentration 3 times as high as the measured concentration of the waste.

7. A process according to claim 3, wherein powder of at least one member selected from the group consisting of activated carbon, silica gel, molecular sieve, and alumina is used as the adsorbent.

8. A process for the treatment of detergent containing radioactive liquid waste, said waste comprising sodium sulfate and powdery ion exchange resin, said process comprising:

(a) providing detergent containing radioactive liquid waste;

(b) concentrating the liquid waste to a known chemical oxidation demand concentration;

(c) adding a fixed amount of adsorbent to the liquid waste from (b), the amount of adsorbent added being based on the known chemical oxidation demand concentration of the liquid waste from (b);

(d) concentrating and drying the liquid waste from (c) thereby converting the liquid waste into powder.

9. A process according to claims 1, 2 or 8, wherein the powder is formed by feeding the radioactive liquid waste to a thin film evaporator comprising a vessel having inside a rotary shaft provided with wiping blades and having a heating means, and concentrating and drying the liquid waste therein by heating, thereby converting the liquid waste to powder form.

10. A process according to claim 9, wherein the adsorbent added to the waste is at a concentration not lower than the measured concentration of the liquid waste.

11. A process according to claim 10, wherein the adsorbent added to the liquid waste is at a concentration 2 to 4 times as high as the measured concentration of the liquid waste.

12. A process according to claim 11, wherein powder of at least one member selected from the group consisting of activated carbon, silica gel, molecular sieve, and alumina is used as the adsorbent.

13. A process according to claim 10, wherein powder of at least one member selected from the group consisting of activated carbon, silica gel, molecular sieve, and alumina is used as the adsorbent.

14. A process according to claim 8, wherein the powder contained 15 wt. % moisture or less and which further comprises a step of shaping the powder into pellets.

15. A process according to claim 8, wherein the adsorbent added to the liquid waste is at a concentration not lower than the known concentration of the waste.

16. A process according to claim 15, wherein the adsorbent added to the waste is at a concentration 2 to 4 times as high as the known concentration of the waste.

17. The process according to claim 15, wherein the adsorbent added to the waste is at a concentration of 3 times the known concentration of the waste.

18. A process according to claim 8, wherein powder of at least one member selected from the group consisting of activated carbon, silica gel, molecular sieves, and alumina is used as the adsorbent.

* * * * *